US006922978B2

(12) United States Patent
Gualchierani

(10) Patent No.: US 6,922,978 B2
(45) Date of Patent: Aug. 2, 2005

(54) WRAPPING DEVICE IN A PRESS FOR FORMING BALES OF TEXTILE MATERIAL

(75) Inventor: Sergio Gualchierani, Prato (IT)

(73) Assignee: Gualchierani Textile Automation S.p.A., Prato (IT)

( * ) Notice: Subject to any disclaimer, the term of this patent is extended or adjusted under 35 U.S.C. 154(b) by 16 days.

(21) Appl. No.: 10/483,891

(22) PCT Filed: Jul. 8, 2002

(86) PCT No.: PCT/IT02/00446

§ 371 (c)(1),
(2), (4) Date: Jan. 12, 2004

(87) PCT Pub. No.: WO03/006318

PCT Pub. Date: Jan. 23, 2003

(65) Prior Publication Data

US 2004/0250696 A1 Dec. 16, 2004

(30) Foreign Application Priority Data

Jul. 13, 2001 (IT) ..... FI2001A0135

(51) Int. Cl.[7] ..... B65B 27/12

(52) U.S. Cl. ..... 53/529; 53/176; 53/209; 53/211; 53/228

(58) Field of Search ..... 53/138.1, 176, 53/528–530, 209, 211, 228; B65B 27/12

(56) References Cited

U.S. PATENT DOCUMENTS 4,318,264 A 3/1982 Rewitzer
4,343,132 A * 8/1982 Lawless, Jr. ..... 53/399
4,959,948 A * 10/1990 Fleissner ..... 53/528
5,125,210 A 6/1992 Lang et al.
5,131,210 A * 7/1992 Kiya ..... 53/399
5,775,058 A 7/1998 Hirschek
6,470,655 B1 * 10/2002 Schwede ..... 53/586

FOREIGN PATENT DOCUMENTS

| | | | |
|---|---|---|---|
| EP | 0075162 A1 * | 3/1983 | ..... B65B/27/12 |
| EP | 0 220 980 | 5/1987 | |
| EP | 0 294 820 | 12/1988 | |
| IT | 1201240 | 2/1985 | |
| IT | 1201292 | 5/1985 | |
| IT | 1214914 | 8/1985 | |
| IT | 207273 | 5/1986 | |
| WO | WO 00/38908 | 7/2000 | |
| WO | WO 02/38364 A1 * | 5/2002 | ..... B65B/27/12 |

* cited by examiner

*Primary Examiner*—Stephen F. Gerrity
(74) *Attorney, Agent, or Firm*—McGlew and Tuttle, P.C.

(57) ABSTRACT

The press comprises at least one final pressing station with a standing press comprising one upper pressing plate and one lower pressing plate; the plates are fitted on coaxial coupling attachments (202) and turned on the vertical axis X—X with the bale after final pressing; a lateral sheet (T10) is unwound from a vertical axis reel (206) and is wrapped laterally on the bale, at least partially, by effect of the rotation of the pressing plates, obtained by the presence of the coupling attachments; a cutting device and fasteners (208, 228) for temporary fastening of the ends of the piece (TS) of sheet (T10) to the plates of the press, for binding are provided.

14 Claims, 4 Drawing Sheets

101
103
105
107
109
111
113
115
117
119
121
125
127
129
129A
131
135
137
141
147
149
151
162
163
164
165
201
202
204
R
T
T1
B3
M
f113
f127

X
164
105
T
T1
151
137
VII
202
208
III
T2
B3
B
T10
T3
210
204
T4
141
X

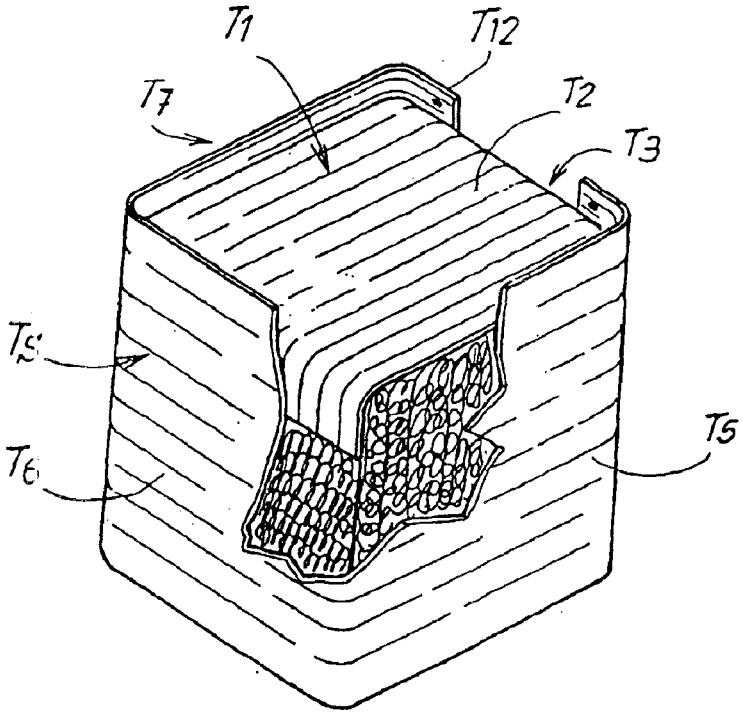
Fig. 8
Fig.9
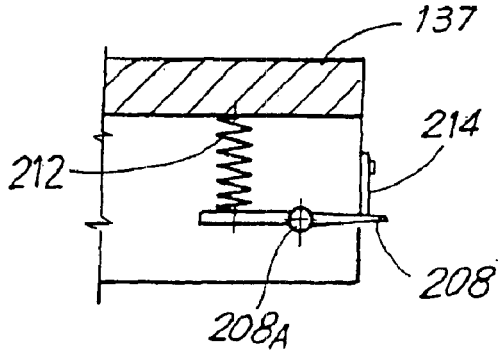
Fig.10
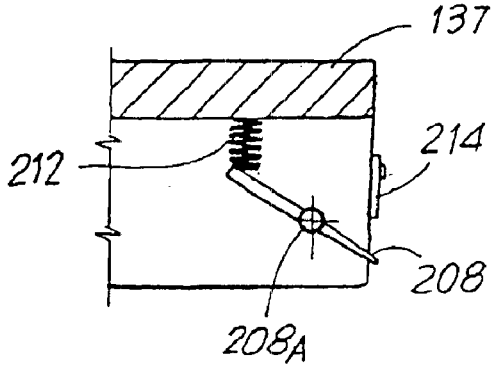

WRAPPING DEVICE IN A PRESS FOR FORMING BALES OF TEXTILE MATERIAL

FIELD OF THE INVENTION

The present invention relates to a press for forming bales of textile material or other materials, of the type comprising a final pressing and binding station with a standing press.

STATE OF THE ART

Two-station presses, i.e. presses with a pre-pressing station and a final pressing and binding station, are described, for example, in Italian Patents no. 1,201,292, 1,201,240, 1,214,914 and in Italian Utility Model no. 207,273. These presses employ a carriage, which in certain cases also defines the pre-pressing chamber, which transfers the partially pressed material in the pre-pressing station to the final pressing and binding station. This solution is efficient but entails relatively high costs, particularly when the press is designed according to the user's specific requirements.

A perfected type of two-station press is described in WO-A-0038908.

OBJECTS AND SUMMARY OF THE INVENTION

Object of the present invention is to create a press which can be used to obtain a packaged product, i.e. a product which is at least partially wrapped in a sheet, which may be a sheet of plastic or other suitable material, in a fashion which is essentially automated.

A prior Patent Application filed by the Applicant in Italy on 13 Nov. 2000 Italian patent application FI2000A000225, see also WO 02/38364, relates to press for the formation of bales of textile material which provides a partial wrapping. The press comprises: a first pre-pressing station and a second final pressing station; two containment walls (upper and lower) which are approximately parallel and define a transfer course of pre-pressed material from the pre-pressing station to the final pressing station; and a pusher which pushes the material along said course between two containing walls to a space defined by two pressing plates of said second final pressing station. Means for unwinding a wrapping sheet from a horizontal roll and positioning it perpendicularly to the direction of advancement of the material along said transfer course are associated to said second final pressing station, upstream to the pressing plates of the second pressing station. Three sides of the material are wrapped in said sheet when the material is inserted between the pressing plates of the second pressing station. The press described in the aforesaid Patent Application is used to dress three sides of the bale, whose shape is generally rectangular and prismatic, including the two sides which are in contact with the pressing plates.

The invention relates to a solution which can be used to dress at least three lateral sides or also four lateral sides of a bale in a press of the type herein described. This invention may also be advantageously applied to a press of the type described in the aforesaid Patent Application filed on 13 Nov. 2000, or other type, requiring partial wrapping.

Substantially, in a standing press for the formation of textile material bales, comprising an upper plate and a lower plate between which the bale is formed in a final pressing procedure according to the invention:

said plates are fitted on coaxial coupling attachments and are consequently capable of turning;

means are provided to turn said plates and bale after final pressing, a lateral sheet, which is laterally wrapped around the bale, at least partially, by effect of the rotation of the coupling attachments, is unwound from a fixed vertical axis roll, and means for cutting the sheet and for temporarily fastening the end of the piece of sheet thus obtained to the plates of the press are provided.

A strapping device, i.e. a device for strapping the bale, is operated after the rotation.

In a press suitable for forming bales, whose horizontal cross-sections are rectangular, said plates and bales are turned by 360° to wrap at least three lateral surfaces of the bale or also the four lateral surfaces.

Advantageously, a second horizontal axis roll may be provided. The second roll feeds a sheet vertically between the pre-pressing station and the final pressing station. Said sheet is pulled by the pre-compressed bale to rest on the upper and lower surfaces of the bale, on which two plates act, and on the lateral surface, which advances and comes into contact with said vertical sheet, according to the criteria described in said prior Patent Application. The other three lateral surfaces are wrapped according to the present invention.

The means for fastening the sheet which is unwound from the vertical axis roll may comprise oscillating tips, which project from the plates of the press, are radially positioned by elastic means to engage the ends of the piece of sheet and can bend due to the action of said elastic means towards the bale to facilitate releasing the piece of sheet.

The invention will now be described, by the way of example only, with reference to the accompanying drawing illustrating the implementation of the invention in a press of the type described in the prior Patent Application, wherein:

FIG. 8 shows a perspective view of a bale with two wrappings about to be bound, and FIGS. 9 and 10 schematically illustrate fastening means in retaining position and in released position.

Figure 1:
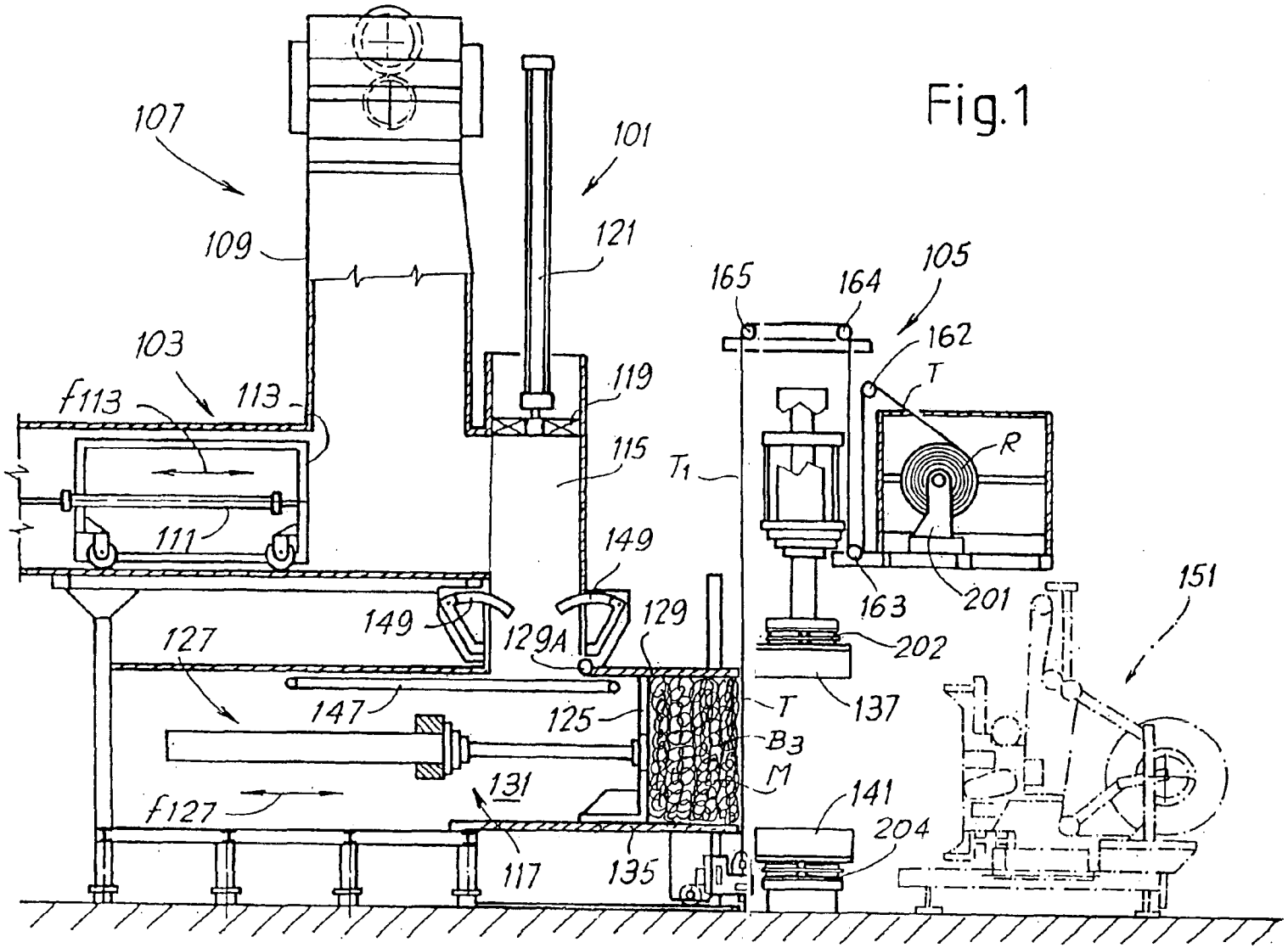
FIG. 1 illustrates a press to which the invention may be applied.

The illustrated press, to which the invention may be applied, is of the type described in the prior Patent Application and is generically indicated with reference numeral 101. It presents a first pre-pressing station 103 and a second pressing and binding station 105. A so-called condenser 107, which feeds the textile material to be packaged in bales, is associated to the pre-pressing station 103. The condenser 107 feeds the textile material into a loader 109, in which a cylinder-piston system 111 with a plate 113—which is capable of alternative movement in the direction of the double arrow f113—unloads the textile material into a loading area 115 over a pre-pressing chamber 117. A pre-pressing plate 119 is associated to the loading area 115 and the pre-pressing chamber 117. The pre-pressing plate 119 is operated by a cylinder-piston actuator 121, e.g. of the hydraulic type. The pre-pressing chamber 117 is delimited by two fixed walls (not visible), which are essentially parallel to the drawing plane, in addition to a plate 125, which forms part of a pusher 127 and by a wall 129, oscillating on a horizontal axis 129A, reason for which said wall 129 can move to a vertical-downwards position and can move to a horizontal position, as shown in FIG. 1.

A horizontal transfer course 131, which includes the chamber 117, is developed between the pre-pressing station 103 and the final pressing station 105. The upper part of the course is delimited by a first wall, which is formed by the vertical wall 129 when it moves to a raised position as shown in FIG. 1. The lower part of the course is delimited by a second horizontal containment wall 135. The latter wall is horizontally mobile in the direction of the plate 125 of the pusher 127. The oscillatory movement of the mobile wall 129 puts the pre-pressing chamber 117 into communication with the transfer course 131 leading to the final pressing station 105 when the wall 129 is raised. The final pressing station 105 comprises a first fixed upper pressing plate 137 and a second lower pressing plate 141. The plate 125 of the pusher 127 is mobile in the direction of the double arrow f127 and presents a horizontally developed cylinder-piston actuator arranged in an extension of the transfer course 131. A horizontal sheet 147 is associated to the plate 125 and moves in the direction of the double arrow f127, which is integral with the plate 125. Two comb systems 149 which can oscillate on horizontal axes to withhold the pre-pressed material inside the pre-pressing chamber 117 when the pre-pressing plate 119 is raised, whereby preventing the pre-pressed material from swelling in the loading area 115, are arranged between the loading area 115 and the pre-pressing chamber 117. A binder 151 is associated to the final pressing and binding station 105, in addition to a carriage with collection device which takes and moves pressed and bound bales away to the final pressing station 105.

As described in the prior Patent Application, a support 201 for a roll R of film or plastic sheet, indicated by reference T, is associated to the second final pressing station 105. This roll is used to wrap three or four sides of the material which was pressed in the final pressing station 105 before binding it, i.e. before the final bale is formed. The sheet T is sent along a course over the pressing plate 137 to be pulled transversally across the transfer course of the pre-pressed textile material from the pre-pressing station 103 to the final pressing station 105. The course of the sheet T is defined by guiding rollers 162, 163, 164, 165 to a vertical lowering trajectory T1. A system for unwinding the sheet T is provided to take the sheet under the level of the lower pressing plate 141. In this way, the final trajectory T1 of the sheet T fully intercepts the course 131 of the pre-pressed material M directed to the final pressing station 105. When the material M advances (rightwards in FIG. 1), the sheet T is intercepted and drawn by the mass M until it is wrapped on three of the six sides of the partially pressed bale of material from the pre-pressing station 103 during the movement of material transfer to the final pressing station 105, as shown by references T2, T3, T4 in FIG. 2. Two of these sides are those on which plates 137 and 141 will act upon while the other side is the one on the right in FIG. 1.

The procedure according to the invention is used to replace or complement the procedure described above and wrap the remaining three lateral sides T5, T6, T7 (FIG. 8) of the bale.

Figure 3:
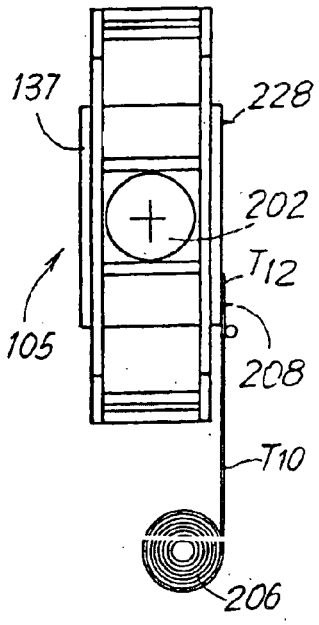
FIGS. 3, 4, 5, 6 and 7 show as many phases of the lateral bale covering operation according to the section III–IV in FIG. 2.
Figure 4:
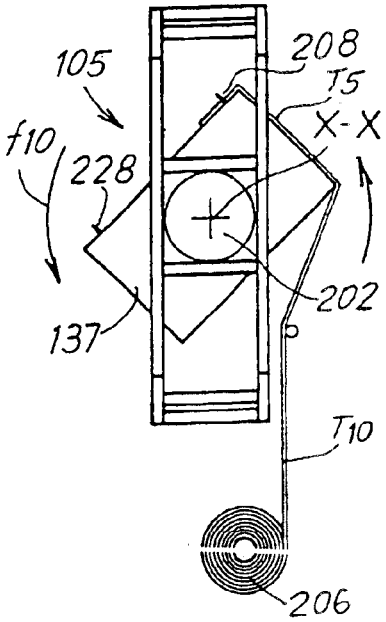
Figure 5:
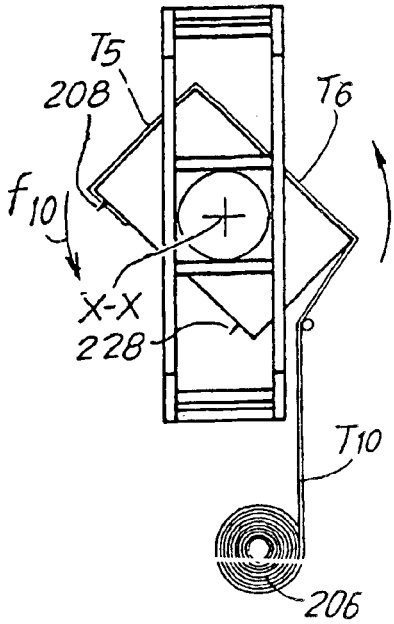

Firstly, the pressing plates 137 and 141 are fitted on coupling attachments 202, 204 which are coaxial to a vertical axis X—X, for which the bale B, which is compressed in the final pressing station 105, can be turned according to the vertical axis X—X of the press. Secondly (specifically see FIGS. 3 from 7), a location for a support for a vertical axis roll 206 is provided next to the final press 105. The roll 206 is capable of supplying—by means of an unwinding mechanism and possible angular movement of the roll 206 itself—a sheet T10, which approaches the side of the bale B laying on a vertical plane, which is immediately external to the side B3 of the bale, which may have been wrapped in the vertical sheet T as described above, where present. The width of the sheet T10 is larger than the height of the bale pressed between the plates 137 and 141; the initial end T12 of the sheet T10 is engaged laterally to the two plates 137, 141 by means of two temporary fastening means, which are generically indicated with reference numerals 208 and 210, to withhold the end T12 which is supported between the two plates 137 and 141. In practice, these fastening means 208 and 210 can be formed by oscillating tips, as shown in FIGS. 9 and 10 schematically as concerns the upper fastening means 208 carried by the plate 137; this tip 208 is articulated in point 208A on plate 137 and stressed by a spring 212 which tends to move the tip 208 against a stop 214, holding the tip 208 essentially horizontal and projecting from the plate 137. A suitable mechanism (not shown) is arranged to push the sheet T10 against the tips of the fastening means 208 and 210 to engage the end T12 of the sheet T10 to said fastening means 208, 210. Said two pressing plates are turned in the direction of the arrow f10 on the axis X—X thanks to the two coupling attachments 202, 204 after final pressing and after engaging the sheet T10 against the plates 137 and 141 and before the plates 137 and 141 are reciprocally distanced. In this way, the three sides T5, T6, T7 of the bale, which are lateral and which may not have been wrapped by the sheet T coming vertically from above, as described in the prior Application.

Alternatively, the sides (i.e. surfaces of the bale) T5, T6, T7 can be the only three to be wrapped in the sheet T10 by making the pressing plates 137, 141 turn synchronously for 360° when the sheet T1 is not provided, as shown in the sequence of the FIGS. from 3 to 7.

Figure 6:
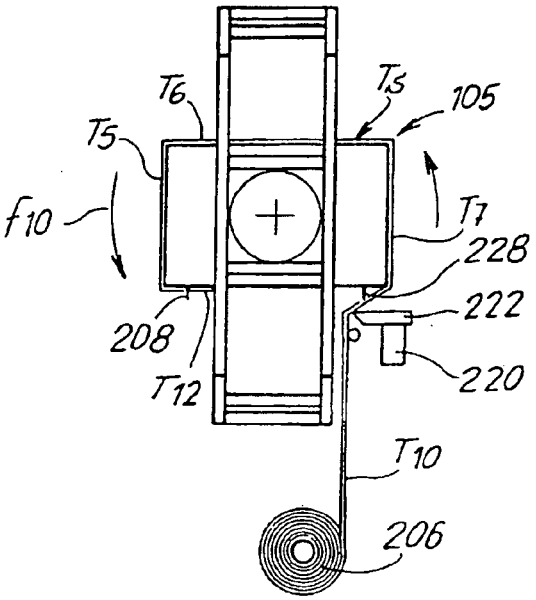

In the rotation position of approximately 270° (FIG. 6), an appropriate cutting mechanism 220 cuts the sheet T10. An associated mechanism 222 has previously approached the ends of the piece of sheet, which must be separated with the mechanism 230, against an additional pair of fastening means 228 and 230 (the latter is not visible), which are also arranged on the plates 137 and 141 in counterpoised position with respect to those of the fastening mechanisms 208 and 210. In the latter conditions, the final rotation of the plates according to f10 is continued for the last 900 according to the arrow f10 to complete the 360° of rotation (FIG. 7), reason for which on the one side the sheet T10 is withheld by the mechanism 220 and approached by the fastening means 208, 210 and on the other part the piece Ts of sheet T10 (cut by the mechanism 220 and engaged by the fastening means 228 and 230) is arranged along the three sides T5, T6, T7 of the bale to wrap them and possibly complete the partial wrapping on the other three sides T2, T3, T4 by the sheet T vertically provided by the roll R in the previous wrapping system.

Figure 7:
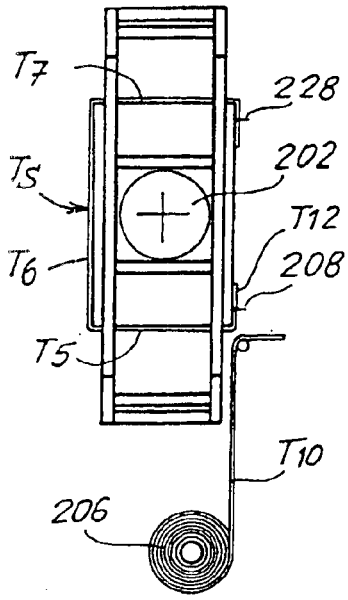

Having reached the position in FIG. 7, the press in the pressing final station 105 returns to the binding position for carrying out the operation with a binding mechanism of the type known for binding the bale and whereby engaging the piece of sheet Ts with the annular straps which enclose the bale and withhold the ends of the piece of sheet Ts, comprising the ends of said sheet previously engaged with the fastening means 208, 210 and 228, 230.

Said fastening means 208, 210, 228, 230 are capable of slanting the upper means 208 and 228 downwards (as shown in FIGS. 9 and 10) and the lower means upwards in the opposite way, the ends of the piece of sheet Ts are easily released from the elastically mobile tips without being torn; afterwards the tips return to the horizontal projecting position by effect of the springs such as 212 for tip 208. In this way, the condition for wrapping the next bale formed by the system is recreated.

The system described can be autonomously applied to a pressing system as the one illustrated which may be equipped with a system for supplying a sheet T for wrapping the three sides (upper, lower and opposite lateral which faces the input direction of the bale in the final pressing station with the press 105) or not.

Figure 2:
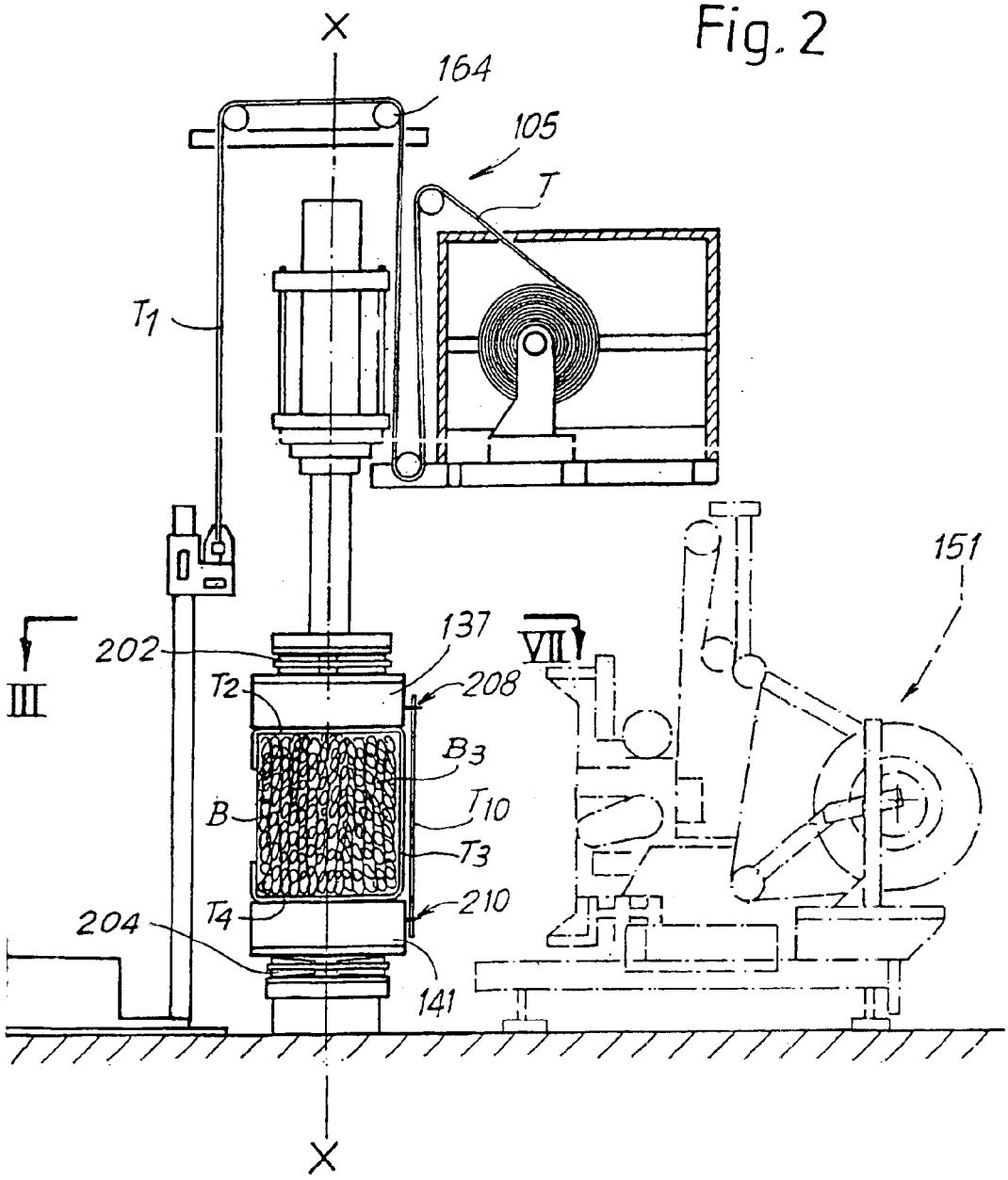
FIG. 2 illustrates a blown-up detail of FIG. 1.

The drawing is provided by the way of an example only to illustrate a practical embodiment of the invention whose shapes and arrangements may vary without departing from the scope of the present invention. Particularly, the press according to the invention can be combined with a press comprising an additional wrapping system which is different from the one described in the prior Patent Application (as illustrated in FIGS. 1 and 2) or with a press without any additional wrapping system.

What is claimed is:

1. A press for forming bales of textile material comprising:

a pre-pressing station and a final pressing station;

the final pressing station including a standing press comprising one upper plate and one lower plate, wherein said plates are fitted on coaxial coupling attachments;

means for rotating said plates and bale after final pressing;

a fixed vertical axis roll of wound lateral sheet material adapted to be laterally wrapped around the bale, at least partially, through rotation of said plates and pressed bale by said means for rotating and by effect of the coupling attachments;

a means for cutting the lateral sheet; and a means for temporarily fastening the end of a portion of the lateral sheet to the plates of the press.

2. The press according to claim 1, further comprising a strap binding device for strapping the bale, and wherein said strap binding device is adapted to be operated after wrapping of the bale.

3. The press according to claim 2, wherein said press is capable of forming a bale whose horizontal cross-section is essentially rectangular, and wherein said plates and said pressed bale are turned by 360° by said means for rotating to wrap three lateral surfaces of the bale with said lateral sheet.

4. The press according to claim 2, wherein said press is capable of forming a bale whose horizontal cross-section is essentially rectangular, and wherein said plates and said pressed bale are turned by said means for rotating to wrap the four lateral surfaces of the bale with said lateral sheet.

5. The press according to claim 2, further comprising a system for wrapping the surfaces in contact with the plates of the press and an unwrapped lateral surface.

6. The press according to claim 2, further comprising a horizontal axis roll which supplies a sheet vertically between the pre-pressing station and the final pressing station, said sheet being drawn by the pre-pressed bale and resting on three surfaces of the bale.

7. The press according to claim 1, wherein said press is capable of forming a bale whose horizontal cross-section is essentially rectangular, and wherein said plates and said pressed bale are turned by 360° by said means for rotating to wrap three lateral surfaces of the bale with said lateral sheet.

8. The press according to claim 7, wherein said press is capable of forming a bale whose horizontal cross-section is essentially rectangular, and wherein said plates and said pressed bale are turned by said means for rotating to wrap the four lateral surfaces of the bale with said lateral sheet.

9. The press according to claim 7, further comprising a system for wrapping the surfaces in contact with the plates of the press and an unwrapped lateral surface.

10. The press according to claim 7, further comprising a horizontal axis roll which supplies a sheet vertically between the pre-pressing station and the final pressing station, said sheet being drawn by the pre-pressed bale and resting on three surfaces of the bale.

11. The press according to claim 1, wherein said press is capable of forming a bale whose horizontal cross-section is essentially rectangular, and wherein said plates and said pressed bale are turned by said means for rotating to wrap the four lateral surfaces of the bale with said lateral sheet.

12. The press according to claim 1, further comprising a system for wrapping the surfaces in contact with the plates of the press and an unwrapped lateral surface.

13. The press according to claim 1, further comprising a horizontal axis roll which supplies a sheet vertically between the pre-pressing station and the final pressing station, said sheet being drawn by the pre-pressed bale and resting on three surfaces of the bale.

14. The press according to claim 1, wherein said means for temporarily fastening comprises oscillating tips which project from the press plates, said tips positioned radially by elastic means to engage the ends of a portion of the lateral sheet, and wherein said tips are adapted to bend towards the bale to release the portion of the lateral sheet by action of the elastic means.

* * * * *